US007404479B1

(12) United States Patent
Shoemaker et al.

(10) Patent No.: US 7,404,479 B1
(45) Date of Patent: Jul. 29, 2008

(54) TOWLINE CART ENGAGEMENT APPARATUS

(75) Inventors: John Shoemaker, Allensville, PA (US); David M. Edwards, Hesston, PA (US)

(73) Assignee: CNH America LLC, New Holland, PA (US)

( * ) Notice: Subject to any disclaimer, the term of this patent is extended or adjusted under 35 U.S.C. 154(b) by 29 days.

(21) Appl. No.: 11/709,667

(22) Filed: Feb. 22, 2007

(51) Int. Cl.
*B61J 3/04* (2006.01)

(52) U.S. Cl. ..... 198/465.1; 104/172.2; 410/84

(58) Field of Classification Search ..... 198/345.3, 198/465.1, 465.2, 867.01; 410/7, 66, 84; 104/172.2, 172.3, 88.01
See application file for complete search history.

(56) References Cited

U.S. PATENT DOCUMENTS 2,816,516 A 12/1957 Diehl
3,048,126 A 8/1962 Salapatas
4,144,818 A * 3/1979 Fletcher ..... 104/172.3
5,368,152 A 11/1994 Rhodes

* cited by examiner

*Primary Examiner*—Stephen Gordon
(74) *Attorney, Agent, or Firm*—John William Stader; Michael G. Harms; Patrick M. Sheldrake

(57) ABSTRACT

The apparatus is a coupling device that couples a cart to a continuously moving towline which is recessed into the cart support surface. A vertically movable coupling pin engages the towline and is lifted away from the towline to disengage the cart from the towline. To prevent irregularities in the support surface from accidentally lifting the pin away from the towline, the pin is attached to the cart through a structure that also permits the cart to move freely relative to the pin but maintain the pin engaged with the towline. The preferred embodiment attaches the coupling pin to a movable tube that moves within a fixed tube, and the movable tube also can be lifted by a cam and locked into a position with the pin disengaged.

6 Claims, 2 Drawing Sheets

TOWLINE CART ENGAGEMENT APPARATUS

BACKGROUND OF THE INVENTION

This invention deals generally with conveyor systems and more specifically with carts moved by an endless chain or towline recessed in the path of the cart and to which the cart is coupled when being moved.

The use of independent carts or other vehicles propelled by a continuously moving towline or chain recessed into a track in the floor is well established in manufacturing and storage facilities. A particular benefit of such systems is that the movement of any cart can be stopped for loading or unloading by disconnecting the cart from the towline and moving it out of the path of the other carts. A common method of coupling the carts to the towline is by the use of a vertically movable coupling pin mounted on the cart. Thus, when the pin is lowered into the recessed floor track and coupled to the towline, the cart moves at the same speed as the towline, and when the pin is raised out of the floor track the cart is stationary.

Typically, the moving towline or chain has coupling fixtures that accept the cart coupling pins and push the pins and the carts along the path. The cart pins are usually manually movable upward out of the floor, and the pins are locked in a high position when disengaged to prevent the pin from inadvertently lowering. When the pins are lowered into the coupling position they are also supported by a fixture on the cart to make the pins accessible for raising.

U.S. Pat. No. 2,816,516 to Diehl shows two notches at the tops of angle bars of different heights, with the higher notch holding the pin in its disengaged position, and the lower notch holding the pin in the position coupling it to the tow chain. U.S. Pat. No. 3,048,126 to Salapatas discloses similar high and low notches in a sleeve to couple and disengage the pin from the towline. U.S. Pat. No. 5,368,152 to Rhodes discloses a pin with a part that rests on the cart frame and lifts the pin out of engagement with the towline when the cart contacts another cart ahead of it.

The problem with all of the prior art coupling pin structures is that they do not accommodate to a cart moving over an uneven surface or even minor obstructions on the supporting surface. All that is necessary to uncouple a cart from the towline is something as mundane as a piece of plywood on the floor over which the cart is moving. In that situation, a cart wheel would move up over the edge of the plywood, but the increased height can lift the coupling pin out of engagement with the towline and stop the cart. Ironically, if the cart included the Rhodes invention described above, the entire production line would soon be brought to a complete halt.

It would be very beneficial to have a coupling pin structure that could accommodate to height variations in the cart support surface and permit the cart to remain coupled to the towline.

SUMMARY OF THE INVENTION

The present invention includes what can best be described as a "floating" coupling pin. Although the pin can be held in one or more high positions to decouple it from a towline propelling a wheeled cart, it has significant free vertical movement, both upward and downward, when it is lowered and coupled to the towline. The result of such a structure is that when the cart wheels are lifted or lowered for any reason, the pin maintains its relationship and coupling to the towline.

The floating coupling pin is constructed by attaching a fixed vertical structure to the cart and attaching the coupling pin to a mobile pin support structure that moves freely vertically relative to the fixed vertical structure. The pin support also has a holding structure that can be moved by a lifting device, so that the pin support can be moved, and the coupling pin can be lifted out of engagement with the towline. However, when the coupling pin is down and coupled to the towline, there is no contact between the holding structure and the lifting device and the pin support structure and the coupling pin are free to move with respect to the cart.

In the preferred embodiment both the fixed vertical structure and the pin support structure are tubes of rectangular cross section, thereby maintaining their orientations with the direction of movement of the cart. The pin support tube has a conventional coupling pin attached to its lower end, and the coupling pin has a length sufficient to engage a towline or tow chain that is recessed into the surface that is supporting the cart wheels. In the preferred embodiment the holding structure is a simple rod attached across the top of the pin support structure, and the lifting device is a pair of cams with one or more slots that hold the rod and the pin support structure high enough to disengage the coupling pin from the towline.

The two cams are located with one on each side of the fixed outer tube so that the cams can be manually operated from either side of the cart. The cams pivot about a point attached to the frame of the cart and include handles to facilitate operation. The cam slots engage the ends of the top rod that extend from the pin support structure to beyond the sides of the fixed outer tube, and the cams lift the pin support structure with their curved surfaces as the cams are rotated. Cutout sections on the cams at one end of the cam rotation are shaped to provide clearance from the top rod, so that the top rod is not contacted and the pin support and the coupling pin are free to move up and down.

The present invention thereby provides a towline coupling apparatus that furnishes the prior art benefits of locking the coupling pin in a raised position for decoupling and lowering the coupling pin for coupling to a towline. However, the present invention provides free vertical movement of the coupling pin when it is coupled to the towline so that variations in the height of the cart support surface do not affect the coupling between the cart and the towline.

DETAILED DESCRIPTION OF THE INVENTION

Figure 1:
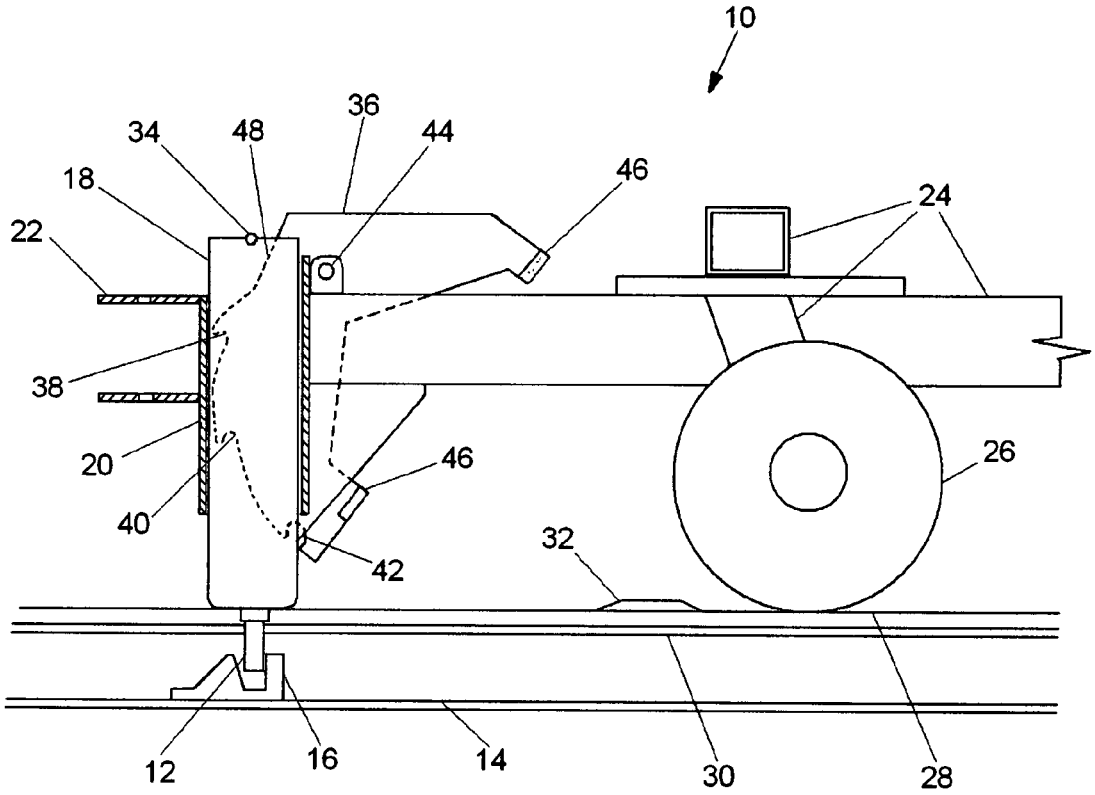
FIG. 1 is a partial cross section view through the longitudinal centerline of the cart showing the basic components of the preferred embodiment of the invention with the coupling pin coupled to the towline.

FIG. 1 is a partial cross section view through the longitudinal centerline of cart 10 showing the basic components of the preferred embodiment of the invention with coupling pin 12 coupled to the towline 14 at coupling fixture 16. Coupling pin 12 is attached to the lower end of pin support 18 which is held by and moves up and down relative to fixed vertical structure 20.

Fixed vertical structure 20 is shown in cross section to better depict its relationship to pin support 18. In the preferred embodiment both fixed vertical structure 20, which is attached to cart frame 24, and pin support 18 are constructed as tubes of rectangular cross section, thereby preventing rotation of pin support 18 and maintaining its orientation with the direction of movement of cart 10.

Cart 10 is constructed conventionally with towing hitch 22 on one or both ends of cart 10, and frame members 24 supporting two pairs of wheels 26. Wheels 26 are supported by floor 28 which has recessed cavity 30 within which towline 14 moves continuously.

As can be seen in FIG. 1, in the preferred embodiment pin support 18 is a tube that floats, that is, it moves freely vertically, within fixed vertical tube 20. Thus, if wheels 26 encounter obstruction 32 and are lifted up, fixed vertical tube 20 merely slides upward with respect to pin support 18, and coupling pin 12 remains engaged with coupling fixture 16 of towline 14. Then, when wheels 26 pass over obstruction 32 and again move down to floor 28 with cart 10 in its previous position, fixed vertical tube 20 simply slides back down along pin support 18, and coupling pin 12 has maintained its contact with towline 14 during the entire movement.

Pin support 18 also has holding structure 34 that can be moved by lifting device 36, so that pin support 18 can be moved, and coupling pin 12 can be lifted out of engagement with coupling fixture 16. However, when coupling pin 12 is down and coupled to towline 14 as shown in FIG. 1, there is no contact between holding structure 34 and lifting device 36, and pin support 18 and the coupling pin 12 are free to move both up and down.

In the preferred embodiment of the invention, the holding structure is rod 34 attached across the top of the pin support 18, and the lifting device is a pair of cams 36 with slots 38, 40, and 42 that each hold rod 34 and pin support 18 in a position high enough to disengage coupling pin 12 from towline 14.

Cams 36 are located with one on each side of the fixed outer tube 20 and cart frame 24 so that only one cam 36 is seen in FIG. 1, but cams 36 can be manually operated from either side of the cart. Cams 36 turn on pivot points 44 that are attached to cart frame 24. Cams 36 also include handles 46 to facilitate their operation. Cutout sections 48 on cams 36 are located at one end of the cam rotation and are shaped to provide clearance from rod 34. Thus, in the position shown in FIG. 1, rod 34 has no contact with cams 36, so vertical tube 20 and cart 10 are free to move up and down relative to pin support 18 and coupling pin 12.

Figure 2:
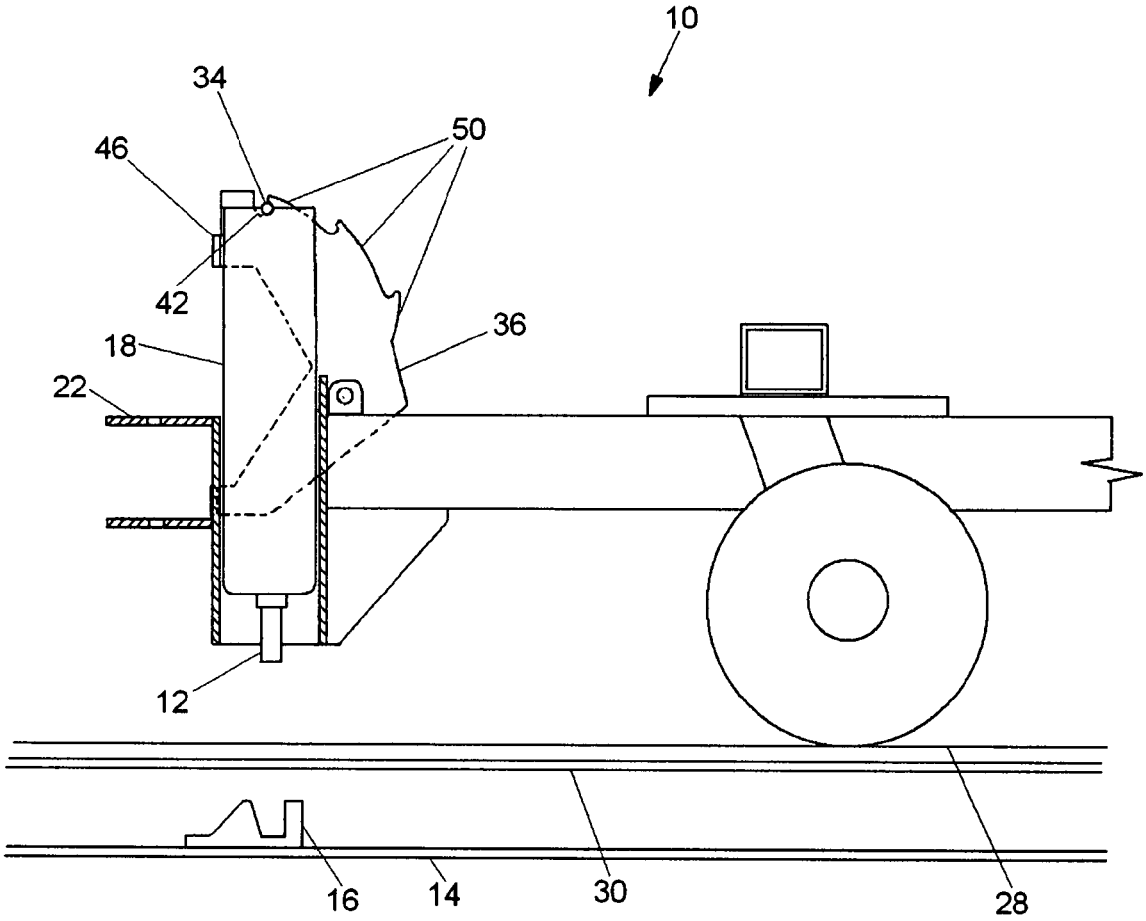
FIG. 2 is a partial cross section view through the longitudinal centerline of the cart showing the basic components of the preferred embodiment of the invention with the coupling pin locked into its highest decoupled position.

FIG. 2 is a partial cross section view through the longitudinal centerline of the same cart 10 as shown in FIG. 1 showing the same basic components of the preferred embodiment of the invention. However, FIG. 2 shows coupling pin 12 decoupled from coupling fixture 16 with rod 34 and pin support 18 locked into their highest positions because rod 34 is engaged by slot 42 on cam 36.

Cam slots 38, 40, and 42 each engage rod 34 at different heights as cams 36 are turned and lift pin support 18, but all the cam slots hold coupling pin 12 disengaged from coupling fixture 16. The lifting action of pin support 18 is accomplished by curved surfaces 50 as cams 36 are rotated, and the several heights can be used to afford several clearance distances for coupling pin 12 above coupling fixture 16. For instance, it may be desirable to have greater clearance of coupling pin 12 above floor 28 when a cart is being placed in storage or moved over ground outside a building, and there may be times when it is desirable to keep coupling pin 12 within recessed cavity 30 even though it is disengaged from coupling fixture 16. Both the quantity and the position of the cam slots can be adjusted to meet these various requirements.

The towline cart engagement apparatus of the present invention thereby provides for easily decoupling and locking the coupling pin in a raised position, but it permits free vertical movement of the cart with respect to the coupling pin when it is coupled to the towline, thus preventing the accidental decoupling of the cart from its towline due to irregularities in the cart support surface.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims. For instance, pin 12 can have a different configuration, pin support 18 can be any vertically moving structure and could easily be external to fixed vertical structure 20, and top rod 34 could also be of a different configuration and in a different location. Furthermore, a device other than cams 36 can be used to lift pin support 18, cart 10 could have a different configuration, and hitch 22 can be located elsewhere on cart 10.

What is claimed as new and for which Letters Patent of the United States are desired to be secured is:

1. An apparatus for coupling a cart to a towline that is located below the cart comprising:

a coupling device that is attached to a cart, is movable vertically, and engages a towline that is located below the cart;

a lifting device for raising the coupling device out of engagement with the towline; and an apparatus to permit the cart to freely move both up and down relative to the coupling device when engaged with the towline.

2. The apparatus of claim 1 further including a locking apparatus to hold the coupling device disengaged from the towline.

3. The apparatus of claim 1 wherein the coupling device is a pin attached to a pin support that moves vertically relative to a fixed structure attached to the cart.

4. The apparatus of claim 1 wherein the coupling device is a pin attached to a pin support that moves vertically relative to a fixed structure that is attached to the cart, and the lifting device is at least one cam that engages the pin support only when lifting the pin support.

5. The apparatus of claim 1 wherein the coupling device is a pin attached to a movable tube that moves vertically relative to a fixed tube which is attached to the cart, and the lifting device is at least one cam that engages the moveable tube only to disengage the moveable tube from the towline.

6. The apparatus of claim 5 further including a rod attached to the movable tube, surfaces on the cam that contact the rod to lift the movable tube, and slots on the cam to contact the rod and hold the movable tube to lock the pin in a position disengaged from the towline.

* * * * *